United States Patent [19]

Duncan

[11] Patent Number: 4,880,961

[45] Date of Patent: Nov. 14, 1989

[54] APPARATUS FOR HEATING YARN

[75] Inventor: James E. Duncan, Richmond, Va.

[73] Assignee: E. I. Du Pont de Nemours and Company, Wilmington, Del.

[21] Appl. No.: 162,965

[22] Filed: Mar. 2, 1988

[51] Int. Cl.[4] ..... H05B 3/42

[52] U.S. Cl. ..... 219/388; 219/469

[58] Field of Search ..... 219/388, 388 S, 469, 219/470, 471; 264/290.5, 290.7

[56] References Cited

U.S. PATENT DOCUMENTS

| | | | |
|---|---|---|---|
| 2,622,182 | 12/1952 | Forzley | 219/470 |
| 2,958,921 | 11/1960 | Gilchrist | 219/388 S |
| 3,257,939 | 6/1966 | McDermott | 219/469 |
| 3,311,691 | 3/1967 | Good | 264/290 |
| 3,518,822 | 7/1970 | McCard | 219/469 |
| 4,535,230 | 8/1985 | Brieu | 219/470 |

FOREIGN PATENT DOCUMENTS

| | | | |
|---|---|---|---|
| 259320 | 4/1970 | U.S.S.R. | 219/388 S |

*Primary Examiner*—Teresa J. Walberg

*Attorney, Agent, or Firm*—Howard P. West, Jr.

[57] ABSTRACT

A yarn heating element wherein fixed elongated core having a heater therein serves as a support for a sleeve rotatably mounted to and telescoped over the core. The space between the core and sleeve can be varied along their lengths for controlling heat radiated from the core to the shell to control the temperature profile along the length of the shell. Varying the winding density of the heater can serve the same purpose.

8 Claims, 3 Drawing Sheets

APPARATUS FOR HEATING YARN

BACKGROUND OF THE INVENTION

This invention relates to an apparatus for heating yarn and, more particularly, it relates to a radiantly heated apparatus to assist in drawing yarn to produce products at higher speeds without loss of yarn properties.

A drawing process in which the present invention is useful is disclosed by Good in U.S. Pat. No. 3,311,691. Good discloses a process for drawing a polyamide yarn that comprises the steps of forwarding a substantially undrawn polyamide yarn to a friction element to provide a first drawing by snubbing the said yarn about the said friction element and removing the said yarn from the said friction element at a linear speed of from about 2.2 to about 5.0 times the rate at which the said yarn is supplied to the said friction element, thereafter while further forwarding the said yarn, simultaneously (A) heating the said yarn through a fixed length of yarn path to a temperature of at least 130° C. and less than 10° C. below the melting point of the said polyamide (B) providing a second drawing of the said yarn by removing the said yarn from the said length of yarn path at a linear speed at least about 1:1 times the rate at which the said yarn is supplied to the said length of yarn path, thereafter maintaining the yarn at constant length while heating substantially at the temperature of the said length of yarn path for a period of from about 0.25 to about 0.60 second and finally cooling the said yarn while forwarding to windup at a linear rate of from about 0.985 to about 0.895 times the rate of the said yarn while maintained at constant length.

The purpose of heating the yarn in step (A) is to reduce yarn draw tension by increasing the yarn's temperature. This is accomplished by passing the yarn around a heated tube. Some heating of the yarn occurs due to friction between the yarn and the tube and some yarn heating occurs as a result of drawing of the yarn as the yarn passes around the tube which is an exothermic process. This creates problems in controlling yarn temperature. Control of the yarn temperature at this location is important to the process because uncontrolled variations in temperature can cause poor operability and less than acceptable yarn mechanical quality.

SUMMARY OF THE INVENTION

The present invention provides a yarn heating element wherein the temperature profile along the length of the element can be controlled to overcome the yarn temperature control problems that are attributable to uncontrolled heating of the yarn noted above.

The yarn heating element comprises a fixed elongated cylindrical core. A sleeve is rotatably mounted to said core, the sleeve is telescoped over said core defining an enclosed space of constant dimension between said sleeve and the core; means are provided for heating the core. In addition, means may be provided for varying the temperature along the length of the core, whereby the temperature profile along the length of the yarn heating element is varied. The sleeve is heated by radiation from the core.

In one embodiment, the space between the sleeve and core varies at least along a portion of its length.

In a preferred embodiment, a cartridge heater is located in the core. The heater is an elongated wound resistance wire heater wherein the winding density of the heater may be varied along its length to vary the temperature along the length of the heater.

DETAILED DESCRIPTION OF THE ILLUSTRATED EMBODIMENTS

Figure 1:
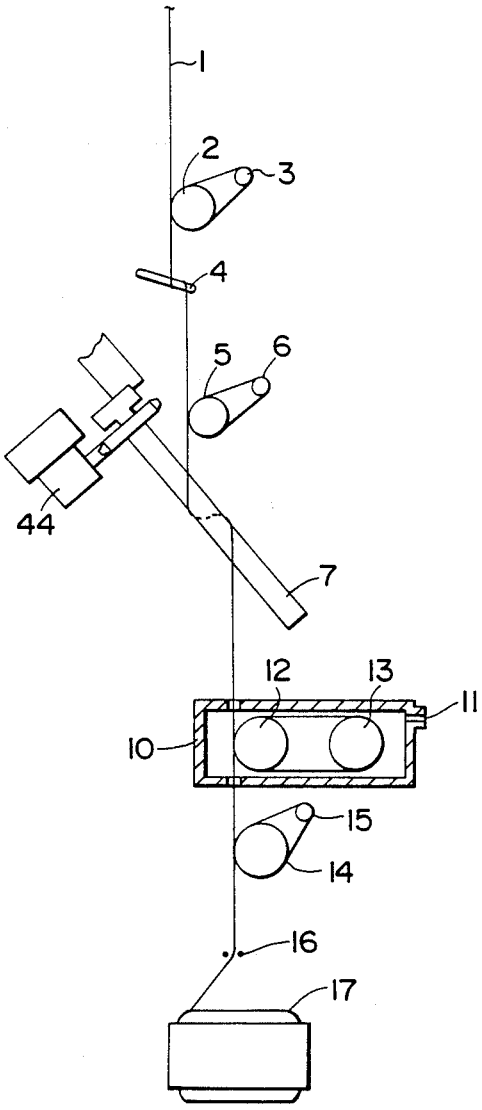
FIG. 1 is a schematic illustration of a process incorporating the apparatus of this invention.

The process chosen for purposes of illustration is substantially the same as that disclosed in U.S. Pat. No. 3,311,691 and is as described in connection with schematic presentation of FIG. 1 wherein driven roll 2 and associated separator roll 3 define a feeding means for yarn 1. Driven roll 5 and associated separator roll 6 form the components of the draw roll for the first drawing stage as well as the feed roll for the second stage. A snubbing pin 4 is provided as a frictional element in the first draw zone. The pin is conveniently made of abrasion resistant material such as aluminum oxide, sapphire, chromium plate or the like. The first draw zone is largely localized at in 4. Yarn heating element 7 heats the yarn forwarded to the second draw zone. Element 7 is heated by an internal electrical heater. Element 7 is tubular with a hard chromium plate surface. The second stage of draw occurs on element 7. Annealing chest 10 is supplied with hot air through duct 11. Driven rolls 12 and 13 provide the tension for the second stage draw and maintain the yarn within chest 10 at a constant length. The hot chest is thermally insulated.

Driven roll 14 and associated separator roll 15 serve as a tension let down system and operate at a lower peripheral speed than rolls 12 and 13. A yarn guide 16 is associated with a conventional wind-up 17. There is a conventional yarn traversing mechanism not shown.

In operation, yarn 1 from a source not shown is forwarded about feed rolls 2, 3 in multiple wraps, and passes around snubbing pin 4. First stage draw roll 5 is operated at a surface speed higher than that of feed roll 2, whereby the yarn is drawn to a specified extent in the first stage while snubbed around pin 4. Yarn leaving roll system 5, 6 passes about the heated tube 7, whereby the yarn is raised in temperature and is subjected to drawing tension provided by rolls 12 and 13. An additional amount of drawing takes place in the second stage draw zone. The yarn is wrapped a number of times about rolls 12 and 13 whereby it is held at elevated temperature and constant length for the time specified. Since the yarn is hot as it leaves chest 10, it will retract spontaneously if given the opportunity to do so. This opportunity is provided by operating rolls 14, 15 at a lower peripheral speed than 12, 13, thus permitting the yarn to relax a predetermined amount. Since rolls 14, 15 are unheated (except by contact with the hot yarn), the yarn is quenched by contact therewith, largely preventing further retraction in subsequent handling steps. Yarn, leaving rolls 14 and 15, is packaged on a conversion windup such as the surface driven no twist windup indicated at 17.

Figure 2:
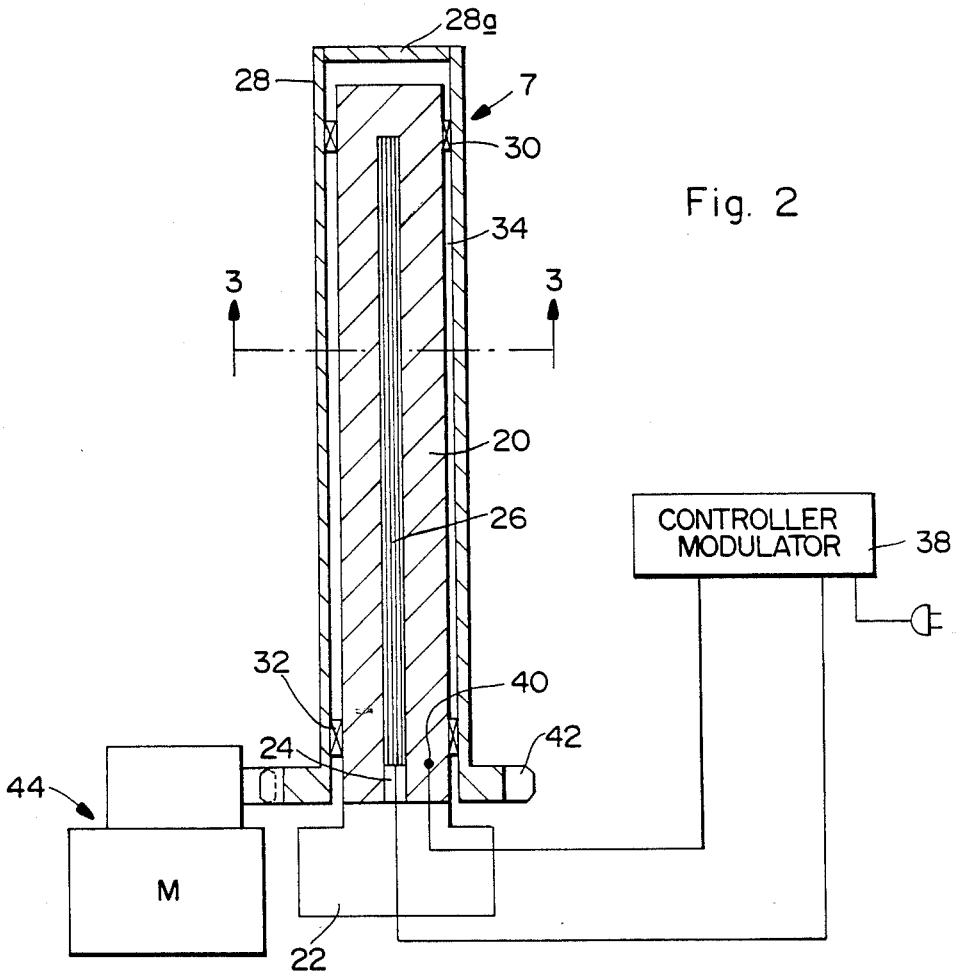
FIG. 2 is an enlarged view of the apparatus of this invention, cross-sectioned along its longitudinal axis and showing the means for energizing and controlling the temperature of the yarn heating element.
Figure 3:
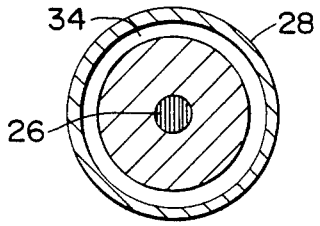
FIG. 3 is a cross-sectioned view of FIG. 2 taken along line 3—3.

Referring now to FIGS. 2 and 3, the yarn heating element 7 comprises an elongated cylindrical core 20 fixed in position to a base 22 which is fixed in relation to the other elements of the process. The core 20 has a central bore 24 with an elongated electrical heater 26 positioned therein. The heater 26 is a Type CIR 5300 cartridge heater having a uniform resistance winding density along its length manufactured by Chromolox , Pittsburgh, Pa. A sleeve 28 telescopes over and is rotatably mounted to the core 20 by means of bearings 30, 32. The sleeve is closed at one end by plate **28*a* and is concentric with core 20 defining an enclosed space 34 between the sleeve and core of constant dimension. The heater 26 is energized through controller modulator 38 connected to line voltage which senses the temperature of core 20 via sensor 40 connected to the controller. Controller 38 is a model Micro P2000 by Electronic Control Systems, Fairmount, W. Va. This embodiment provides a stabilized varying temperature profile along the length of the yarn heating element 7**.

A ring gear 42 is fixed to sleeve 28 at its end near base 22. The ring gear is driven by motor driven gear box 44 to rotate sleeve 28 at about one revolution every eight (8) minutes. The motor driven gear box is a model Flex-o-Action by Merkle-Koroff, Chicago, Ill.

Figure 4:
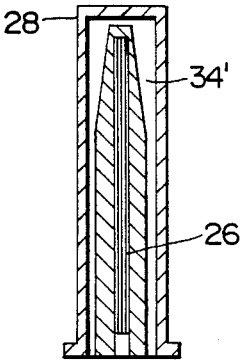
FIGS. 4–7 are sectioned views of the apparatus of this invention taken along its longitudinal axis showing alternate configurations for the core and the sleeve.
Figure 5:
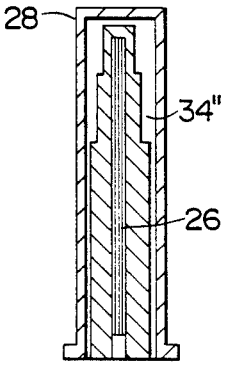
Figure 6:
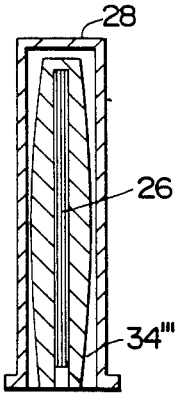
Figure 7:
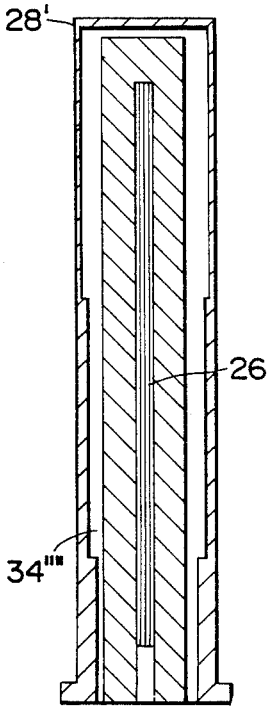

One way to vary the temperature profile of sleeve 28 along the length of the sleeve is to vary the air gap 34 between the outside longitudinal surface of core and the inside longitudinal surface of sleeve 28 at least along a portion of their lengths. For example, FIG. 4 shows the core 20' tapered at one end in a conical shape to provide a changing air gap 34' along a portion of the length of the heating element 7'. The core could, of course, be tapered at both ends. In another embodiment shown in FIG. 5, the core 20'' could have a stepped shape at one end to provide a changing air gap 34'', In still another embodiment shown in FIG. 6 the core 20''' could have a curvilinear surface at one or both ends to provide another changing air gap 34'''. In FIG. 7 the sleeve 28' is formed with a stepped inside diameter to form still another form of varying air gap 34''''.

Figure 8:
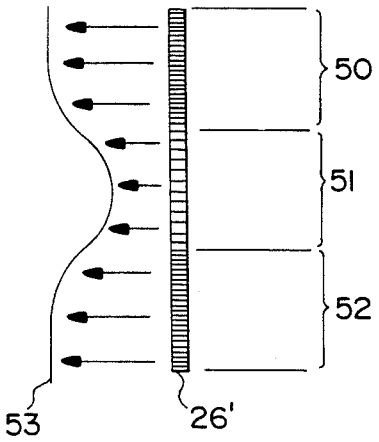
FIGS. 8–10 are schematic illustrations of alternate variations of density of winding of the heater of the apparatus of this invention showing the effect on temperature profile along the length of the apparatus of this invention.
Figure 9:
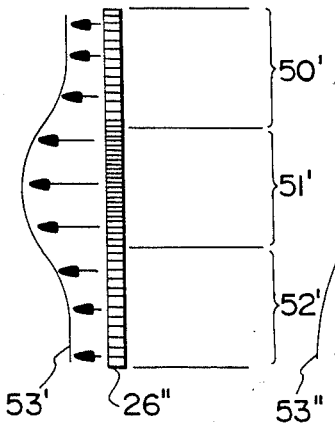
Figure 10:
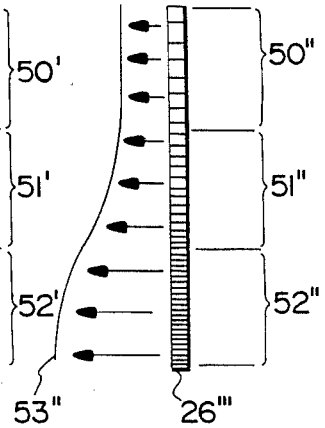
Figure 11:
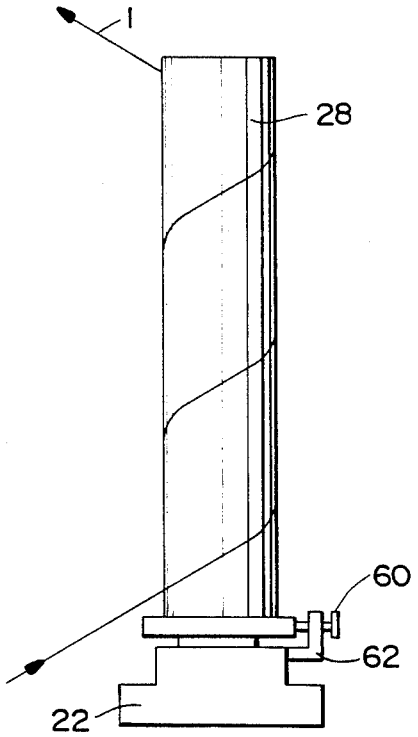
FIG. 11 is a schematic of an alternate embodiment of this invention whereon the rotable sleeve is driven by the yarn passing over the sleeve.

While heater 26 is formed using a uniform resistance winding density along its length, FIGS. 8, 9 and 10 illustrate another way to vary the temperature profile along sleeve 28 by having the cartridge heater 26 formed using different variable resistance wire winding densities. More particularly, for the purposes of illustration, the heaters 26', 26'' and 26''' have been divided into three equal zones. In FIG. 8 heater 26 has been prepared to provide about 40% of the winding density in the top and bottom of zones 50 and 52 while the remainder or 20% is provided in zone 51, thus providing a temperature profile as indicated by curve 53, and such a profile will be essentially radiated to the sleeve 28. Other combinations of winding densities along the length of the cartridge heater are possible with resultant temperature profiles as shown in FIGS. 9 and 10. Other combinations of winding densities and air gap variations are also possible. The illustrated embodiments are not intended to be limiting.

While in the preferred embodiment, sleeve 28 is driven by motor driven gear box 44, it should be understood that sleeve 28 may be driven or rotated by using the friction of the yarn 1 advancing around the sleeve. The speed of rotation is controlled by an adjustable friction device 60 threaded through arm 62 fixed to base 22 so that pressure can be exerted against sleeve 28 by device 60 to brake the sleeve.

I claim:

1. A yarn heating element comprising: a fixed elongated core; a sleeve rotatably mounted to said core, said sleeve being telescoped over said core defining an enclosed space of constant dimension between said sleeve and said core along their length; and means for heating said core and varying the temperature along its length comprising a central bore within said core and an elongated electric heater positioned in said bore, whereby temperature profile along a length of the sleeve is varied.

2. The heating element of claim 1 wherein, said heater is an elongated wound resistance wire cartridge heater positioned in said bore, the winding density of said wound resistance wire cartridge heater varying along the length of said heater; and means for energizing said heater whereby the temperature profile along the length of the heater is varied.

3. A yarn heating element comprising: a fixed elongated cylindrical core, said core having a central bore therein; an elongated electrical heater positioned in said bore; a sleeve rotatably mounted to said core, said sleeve being telescoped over said core defining an enclosed space between said sleeve and said core; and means for energizing said heater, said core having a varying diameter at least along a portion of its length, whereby the space between the core and the sleeve varies along at least a portion of the length of said heating element to vary the temperature profile of the yarn heating element along said portion.

4. A yarn heating element comprising: a fixed elongated cylindrical core, said core having a central bore therein; an elongated electrical heater positioned in said bore; a sleeve rotatably mounted to said core, said sleeve being telescoped over said core defining an enclosed space between said sleeve and said core; and means for energizing said heater, said sleeve having an inside diameter that varies at least along a portion of its length whereby the space between the core varies along at least a portion of the length of the heating element to vary the temperature profile of the yarn heating element along its length.

5. A yarn heating element for use with an apparatus for drawing nylon yarn that includes at least one rotating feed roll and at least one rotating draw roll mounted on a frame for conveying the yarn at a yarn velocity, said draw roll having a surface speed higher than the surface speed of said feed roll to draw yarn conveyed from said feed roll to said draw roll, said yarn heating element being positioned to contact said yarn after leaving said feed roll and before contacting said draw roll to heat said yarn as it is drawn, said yarn heating element comprising: an elongated cylindrical core connected at one of its ends to said frame, said core having a central bore therein; an elongated electrical heater positioned in said bore; a sleeve mounted rotatably to said core, said sleeve being telescoped over said core defining a concentric space of constant width between said sleeve and said core, means for rotating said sleeve at a surface velocity less than the yarn velocity and means for energizing said heater.

6. The yarn heating element of claim 5, said heater being a wound resistance wire cartridge heater, the winding density of said resistance wire varying along the length of said heater, whereby the temperature profile along the length of the cartridge heater is varied.

7. A yarn heating element for use with an apparatus for drawing nylon yarn that includes at least one rotating feed roll and at least one rotating draw roll mounted on a frame for conveying the yarn at a yarn velocity, said draw roll having a surface speed higher than the surface speed; of the feed roll to draw yarn conveyed from said feed roll to said draw roll, said yarn heating element being positioned to contact said yarn after leaving said feed roll and before contacting said draw roll to heat said yarn as it is drawn, said yarn heating element comprising: an elongated cylindrical core connected at one of its ends to said frame, said core having a central bore therein; an elongated electrical heater positioned in said bore; a sleeve mounted rotatably to said core, said sleeve being telescoped over said core defining a concentric space between said sleeve and said core, means for rotating said sleeve at a surface velocity less than the yarn velocity and means for energizing said heater, said yarn heating element further comprising: said core having a varying diameter along its length, whereby the width of said concentric space varies along the length of said heating element to vary the temperature profile of the sleeve along its length.

8. A yarn heating element for use with an apparatus for drawing nylon yarn that includes at least one rotating feed roll and at least one rotating draw roll mounted on a frame for conveying the yarn at a yarn velocity, said draw roll having a surface speed higher than the surface speed of the feed roll to draw yarn conveyed from said feed roll to said draw roll, said yarn heating element being positioned to contact said yarn after leaving said feed roll and before contacting said draw roll to heat said yarn as it is drawn, said yarn heating element comprising: an elongated cylindrical core connected at one of its ends to said frame, said core having a central bore therein; an elongated electrical heater positioned in said bore; a sleeve mounted rotatably to said core, said sleeve being telescoped over said core defining a concentric space between said sleeve and said core, means for rotating said sleeve at a surface velocity less than the yarn velocity and means for energizing said heater, said yarn heating element further comprising: said sleeve having an inside diameter that varies along its length whereby the width of said concentric space varies along the length of the heating element to vary the temperature profile of the sleeve along its length.

* * * * *